US011854507B2

(12) United States Patent
Yang

(10) Patent No.: US 11,854,507 B2
(45) Date of Patent: Dec. 26, 2023

(54) LIQUID CRYSTAL DISPLAY DEVICE AND OPERATION METHOD THEREOF

(71) Applicant: LG ELECTRONICS INC., Seoul (KR)

(72) Inventor: Jinmo Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/906,598

(22) PCT Filed: Mar. 20, 2020

(86) PCT No.: PCT/KR2020/003912
§ 371 (c)(1),
(2) Date: Sep. 16, 2022

(87) PCT Pub. No.: WO2021/187652
PCT Pub. Date: Sep. 23, 2021

(65) Prior Publication Data

US 2023/0126793 A1 Apr. 27, 2023

(51) Int. Cl.
*G09G 3/36* (2006.01)

(52) U.S. Cl.
CPC ..... *G09G 3/3614* (2013.01); *G09G 3/3688* (2013.01); *G09G 2310/08* (2013.01);
(Continued)

(58) Field of Classification Search
CPC ..... G09G 3/3614; G09G 3/3648
See application file for complete search history.

(56) References Cited

U.S. PATENT DOCUMENTS

2005/0146490 A1* 7/2005 Kang ..... G09G 3/3614 345/76
2008/0252624 A1* 10/2008 Jang ..... G09G 3/3648 345/204

(Continued)

FOREIGN PATENT DOCUMENTS

JP 2004302410 10/2004
KR 100590064 6/2006

(Continued)

OTHER PUBLICATIONS

Murai Toshiharu JP2004302410 Oct. 28, 2004 (Year: 2004).*
PCT International Application No. PCT/KR2020/003912, International Search Report dated Dec. 14, 2020, 2 pages.

*Primary Examiner* — Van N Chow
(74) *Attorney, Agent, or Firm* — LEE HONG DEGERMAN KANG WAIMEY

(57) ABSTRACT

An embodiment of the present disclosure provides a liquid crystal display device for improving an afterimage or flicker, the liquid crystal display device comprising: a display panel where a plurality of gate lines and a plurality of data lines are formed, and including a plurality of pixels; a gate driving unit for applying a gate signal to the plurality of gate lines; a data driving unit for applying a data voltage to the plurality of data lines, and a timing controller for generating a gate driving signal and a data driving signal corresponding to image data, modifying the generated data driving signal such that the polarity of the data voltage is reversed alternately for each per-determined frame unit with respect to the generated data driving signal, applying the generated gate driving signal to the gate driving unit, and applying the modified data driving signal to the data driving unit.

8 Claims, 8 Drawing Sheets

(52) U.S. Cl.
CPC ..... *G09G 2320/0247* (2013.01); *G09G 2320/0257* (2013.01)

(56) References Cited

U.S. PATENT DOCUMENTS

| | | | | |
|---|---|---|---|---|
| 2009/0167664 | A1 | 7/2009 | Song et al. | |
| 2009/0273557 | A1* | 11/2009 | Song | G09G 3/3648 345/87 |
| 2010/0277494 | A1* | 11/2010 | Cho | G09G 3/3648 345/589 |
| 2014/0232624 | A1* | 8/2014 | Kim | G09G 3/3607 345/87 |

FOREIGN PATENT DOCUMENTS

| | | |
|---|---|---|
| KR | 1020090058982 | 6/2009 |
| KR | 1020170080319 | 7/2017 |

* cited by examiner

LIQUID CRYSTAL DISPLAY DEVICE AND OPERATION METHOD THEREOF

CROSS-REFERENCE TO RELATED APPLICATION(S)

This application is the National Stage filing under 35 U.S.C. 371 of International Application No. PCT/KR2020/003912, filed on Mar. 20, 2020, the contents of which are all incorporated by reference herein in its entirety.

[TECHNICAL FIELD]

The present disclosure relates to a display device for improving an afterimage or flicker and a method of operating the same.

[BACKGROUND ART]

A liquid crystal display device is a display device that obtains a desired image signal by applying a voltage to a liquid crystal material having an anisotropic dielectric constant injected between two substrates and controlling the intensity of this voltage to control the amount of light transmitted through the substrate. Specifically, in the liquid crystal display device, when a voltage is applied to the liquid crystal, the arrangement of the liquid crystal is changed, light is transmitted through the liquid crystal in this state to generate diffraction and then is polarized to output the desired image.

In a TFT liquid crystal display device, pixels each having a thin film transistor and a pixel electrode connected to the thin film transistor as a basic unit are arranged vertically and horizontally, and each of a plurality of gate lines and data lines electrically connected to each thin film transistor may be formed. The operation of each pixel is controlled based on a driving signal (or driving voltage) applied through the gate line, a data signal (or data voltage) applied through the data line, and a common voltage $V_{COM}$ applied through a common electrode.

However, a shift may occur in the common voltage in a situation in which a white image and a black image rapidly cross. In particular, a shift may occur in the common voltage in a situation where a fixed pattern such as a program logo or a menu background is exposed for a long time. If a shift occurs in the common voltage, there is a problem in that an afterimage or flicker is generated even when a normal signal is applied.

FIGS. 1 and 2 show an afterimage or flicker generated in an existing liquid crystal display device.

Specifically, FIG. 1 shows an afterimage generated in response to a fixed pattern that has been output for a long time, in a situation in which an image is switched after a fixed pattern such as a logo has been output for a long time. FIG. 2 shows an afterimage or flicker generated in response to a fixed pattern that has been output for a long time, which occurs in a situation in which an image is switched after a fixed pattern has been output for a long time. Such an afterimage or flicker acts as a factor that degrades the output quality of the liquid crystal display device, and is a factor that degrades user satisfaction.

[INVENTION]

[TECHNICAL PROBLEM]

An object of the present disclosure is to provide a liquid crystal display device for improving an afterimage or flicker generated as a common voltage applied to a display panel is shifted, and a method for controlling the same.

[TECHNICAL SOLUTION]

An embodiment of the present disclosure provides a liquid crystal display device comprising a display panel having a plurality of gate lines and a plurality of data lines formed thereon and including a plurality of pixels, a gate driver configured to apply a gate signal to the plurality of gate lines, data driver configured to apply a data voltage to the plurality of data lines, and a timing controller configured to generate a gate driving signal and a data driving signal corresponding to image data, to modify the generated data driving signal to alternately invert a polarity of the data voltage at a predetermined period with respect to the generated data driving signal, to apply the generated gate driving signal to the gate driver, and to apply the modified data driving signal to the data driver, and a method of controlling the same.

The gate driver may generate a gate signal corresponding to the generated gate driving signal and apply the generated gate signal to the plurality of gate lines, and the data driver may generate a data voltage corresponding to the modified data driving signal and apply the generated data voltage to the plurality of data lines.

The generated data voltage may comprise a first period in which a polarity is not inverted and a second period in which a polarity is not inverted, and the first period and the second period may be alternately arranged.

The predetermined period may be a value set by user input or an administrator.

The predetermined period may be a unit of time or a unit of frame.

The predetermined period may be determined in consideration of a scan rate of the display panel.

The predetermined period may be a product of the scan rate and a predetermined period in units of time.

[EFFECT OF THE INVENTION]

According to various embodiments of the present disclosure, even if a fixed pattern is output for a long time, an afterimage or flicker may be effectively improved by suppressing a shift of a common voltage.

[BEST MODE]

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" or "unit" may be used to refer to elements or components. Use of such a suffix herein is merely intended to facilitate description of the specification, and the suffix itself is not intended to have any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

While the terms including ordinal numbers such as 'first', 'second', etc. may be used to describe various components, they are not intended to limit the components. These terms may be used to distinguish one component from another component.

When it is said that a component is 'coupled with/to' or 'connected to' another component, it should be understood that the one component is connected to the other component directly or through any other component in between. On the other hand, when it is said that a component is 'directly connected to' or 'directly coupled to' another component, it should be understood that there is no other component between the components.

Figure 1:
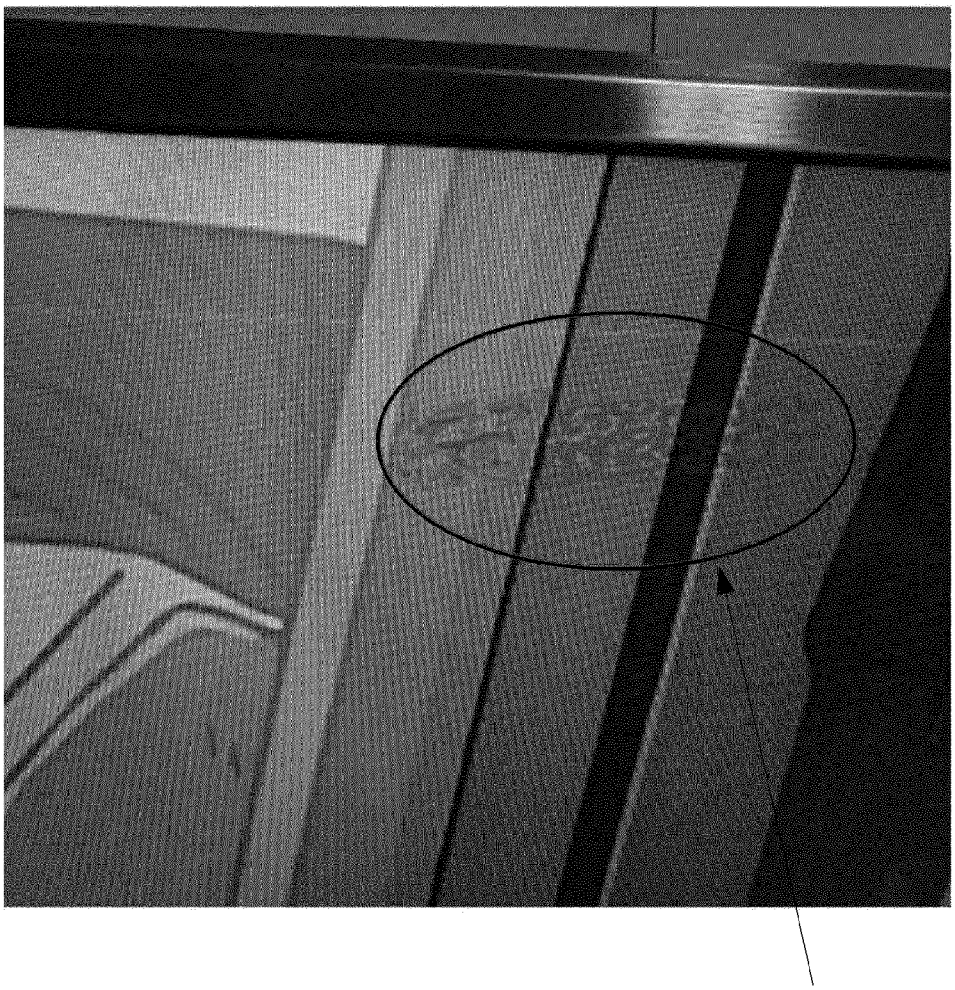
FIGS. 1 and 2 show an afterimage or flicker generated in an existing liquid crystal display device.
Figure 2:
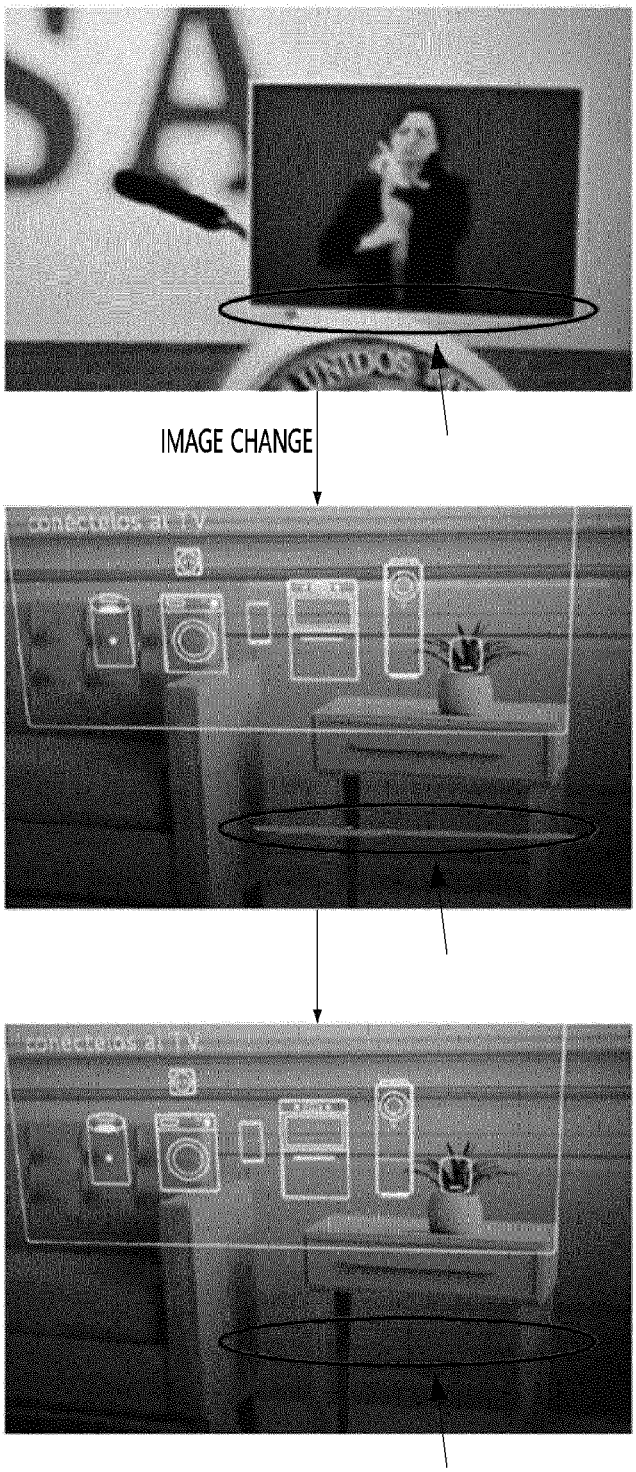
Figure 3:
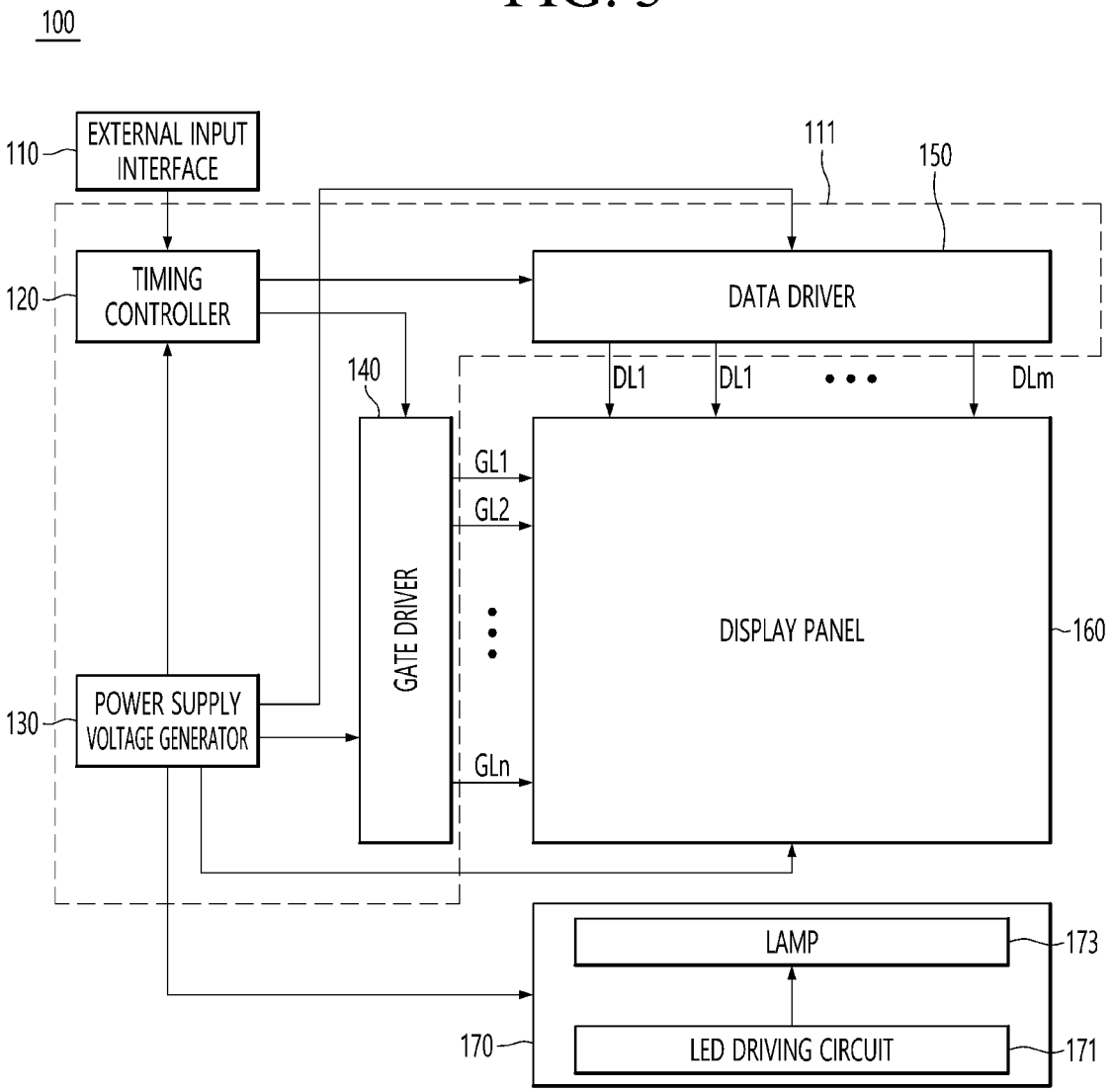
FIG. 3 is a diagram illustrating a liquid crystal display device 100 according to an embodiment of the present disclosure.

FIG. 3 is a diagram illustrating a liquid crystal display device 100 according to an embodiment of the present disclosure.

The liquid crystal display device 100 according to an embodiment of the present disclosure may be implemented in various forms such as a monitor, a TV, a tablet, a PC, a laptop, a mobile terminal, etc.

Referring to FIG. 3, the liquid crystal display device 100 may include an external input interface 110, a driving circuit 111, a display panel 160 and a backlight unit 170.

The external input interface 110 may receive image data or a control signal for image output from an external device.

The display panel 160 may include a plurality of data lines DL1 to DLm and a plurality of gate lines GL1 to GLn intersecting on a substrate in the form of a matrix, and a plurality of pixels corresponding to the intersections.

Each of the plurality of pixels may output an image based on a data signal provided by a data driver 150, a gate signal provided by a gate driver 140 and light provided by the backlight unit 170.

The backlight unit 170 may provide light to the display panel 160.

The external input interface 110 may receive a control signal including one or more of RGB data, a clock signal, a horizontal synchronization signal, a vertical synchronization signal, and a data enable signal from an external device. The horizontal synchronization signal may be a signal for horizontal synchronization of the screen. The vertical synchronization signal may be a signal for vertical synchronization of the screen. The data enable signal may indicate a period during which data is supplied to the pixel.

The external input interface 110 may be included in the driving circuit 111.

The driving circuit 111 may include a timing controller 120, a power supply voltage generator 130, a gate driver 140 and a data driver 150.

The timing controller 120 may generate a gate driving signal for driving the gate driver 140 composed of a plurality of drive integrated circuits and a data driving signal for driving the data driver 150 composed of a plurality of drive integrated circuits, using the control signal received from the external input interface 110. For example, the driving signal for driving the gate driver 140 may include a high signal, a gate low signal, a clock signal, a start signal, a reset signal, etc.

The timing controller 120 may be referred to as a controller.

The power supply voltage generator 130 may supply a power supply voltage, a reference voltage and a ground voltage necessary for operation of each component included in the driving circuit 111.

The power supply voltage generator 130 may supply a common voltage $V_{COM}$ corresponding to the reference voltage to the display panel 160.

The power supply voltage generator 130 may supply power necessary to drive the backlight unit 170.

The gate driver 140 may perform on/off control of each of the plurality of pixels included in the display panel 160, in response to the driving signal received from the timing controller 120. In addition, the gate driver 140 may output gate driving signals (or gate signals) Vg1 to Vgn and sequentially enable the gate lines GL1 to GLn on the display panel 160 by one horizontal synchronization time.

The data driver 150 may apply an image signal (or a data voltage, a data signal) to each pixel in response to a data signal and a driving signal received from the timing controller 120. Accordingly, image signals supplied from the data driver 150 may be applied to each pixel of the display panel 160.

The backlight unit 170 may be disposed on one surface of the display panel 160 to provide light to the display panel 160.

The backlight unit 170 may include a lamp 173 and an LED driving circuit 171.

The lamp 173 may provide light to the display panel 160.

The lamp 173 may provide light to the display panel 160 so that the display panel 160 implements a High Dynamic Range (HDR) image according to the control of the LED driving circuit 171. For this, a local dimming method may be used. Local dimming may be a method of turning on or off lighting in a specific area of the screen.

The lamp 173 may include a plurality of channels. Each channel may include one or more LED elements connected in series, a dimming circuit and a resistor. The plurality of channels may be connected in parallel to be electrically connected to the LED driving circuit 171.

Each LED element may emit a monochromatic light of red, green or blue, or may emit white light.

The dimming circuit may be a semiconductor switch capable of turning on or off one or more LED elements. The dimming circuit may consist of a Field Effect Transistor (FET).

The resistor may be used to measure current flowing in one channel. A DC voltage supplied from the power supply voltage generator 130 to the lamp 173 may be lowered through one or more LED elements, and the lowered voltage may be applied to the resistor. By measuring the voltage across the resistor, the current flowing through the channel may be measured.

The LED driving circuit 171 may control operation of the lamp 173.

The LED driving circuit 171 may include a plurality of LED drivers.

The number of LED drivers included in the LED driving circuit 171 may be less than the number of channels included in the lamp 173.

The number of LED drivers may be equal to the number of dimming circuits. In this case, the number of dimming circuits may be less than the number of channels.

The LED driving circuit 171 may control operation of the plurality of channels based on a time division alternating control method.

Figure 4:
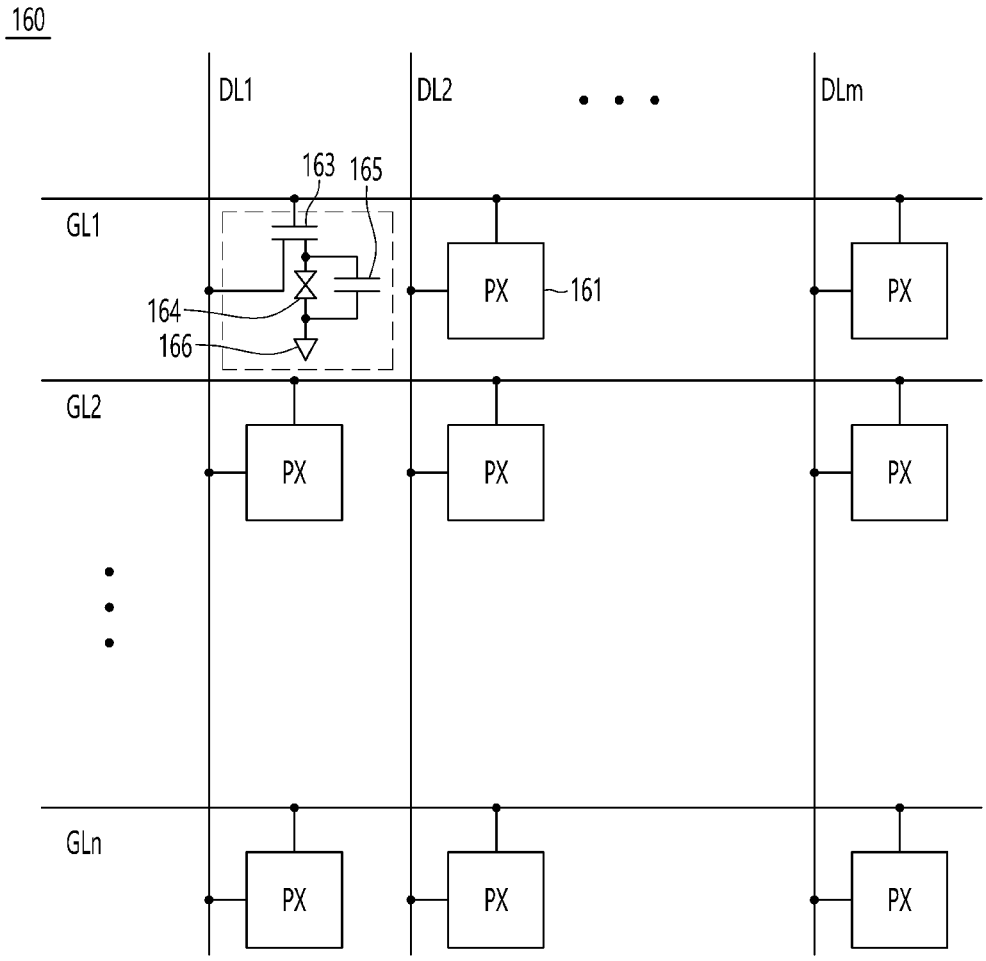
FIG. 4 is a view showing the display panel 160 according to an embodiment of the present disclosure.

FIG. 4 is a view showing the display panel 160 according to an embodiment of the present disclosure.

Referring to FIG. 4, the display panel 160 may include the plurality of gate lines GL1 to GLn connected to the gate driver 140 and the plurality of data lines DL1 to DLm connected to the data driver 150, which are perpendicular to each other on the substrate in the form of a matrix, and pixels PX 161 corresponding to the intersections. Therefore, the pixels 161 included in the display panel 160 may be arranged in the form of a matrix.

The gate lines GL1 to GLn may transmit the gate driving signal (or scan signal) to the pixels 161 and the data lines DL1 to DLn transmit image signals (or data voltage) to the pixel 161.

Each pixel 161 may include a thin film transistor (TFT) 163, a liquid crystal capacitor (Clc) 164, and a storage capacitor (Cst) 165. The storage capacitor 165 may be omitted.

The liquid crystal capacitor 164 and the storage capacitor 165 may be connected in parallel between the drain of the thin film transistor 163 and a common voltage source $V_{COM}$ 166.

The thin film transistor 163 may be turned on when a voltage higher than a threshold voltage is applied to the gate, thereby connecting the data lines DL1 to DLm to the liquid crystal capacitor 164 and the storage capacitor 165. The liquid crystal capacitor 164 and the storage capacitor 165 may accumulate data voltages from the data lines DL1 to DLm when the thin film transistor 163 is turned on, and maintain it until the thin film transistor 163 is turned on again.

Figure 5:
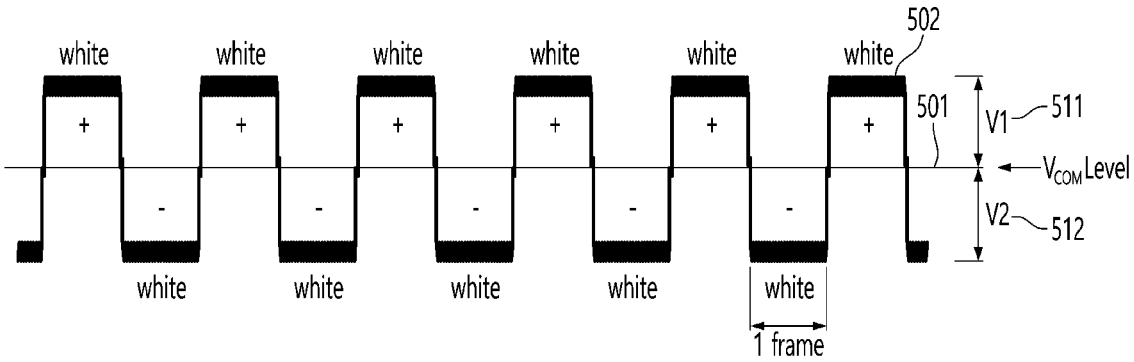
FIG. 5 is a view illustrating a common voltage and a data voltage in a situation in which a common voltage shift does not occur.

FIG. 5 is a view illustrating a common voltage and a data voltage in a situation in which a common voltage shift does not occur.

In a data voltage 502 shown in FIG. 5, a white signal (image signal or data voltage corresponding to a white color) is repeated in units of frames.

Referring to FIG. 5, in a situation in which a common voltage shift ($V_{COM}$ shift) does not occur, the level of the common voltage $V_{COM}$ 501 may be an intermediate value between a crest and a trough of the data voltage 502. In the data voltage 502 , a white signal is repeated in units of frames, and a potential difference V1 511 between the crest of the data voltage 502 and the common voltage 501 and a potential difference V2 512 between the trough of the data voltage 502 and the common voltage 501 may be equally maintained. The crest of the data voltage 502 may indicate a positive voltage or a positive signal, and the trough of the data voltage 502 may indicate a negative voltage or a negative signal.

As the potential difference between the data voltage 502 and the common voltage 501 increases, the pixel outputs a white color (bright), and as the potential difference between the data voltage 502 and the common voltage 501 decreases, the pixel outputs a black color (dark).

Figure 6:
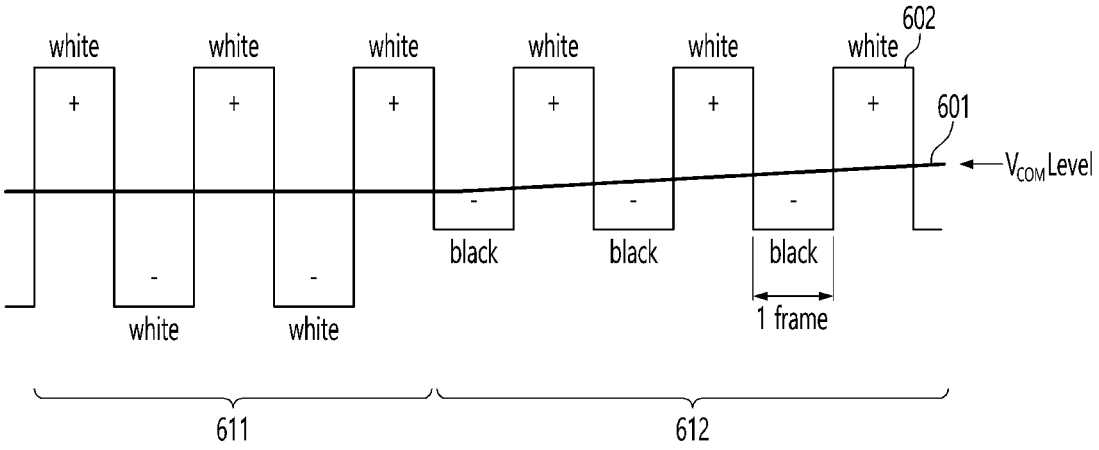
FIG. 6 is a view illustrating a common voltage and a data voltage in a situation in which a common voltage shift occurs.

FIG. 6 is a view illustrating a common voltage and a data voltage in a situation in which a common voltage shift occurs.

In the data voltage 602 shown in FIG. 6, a white signal is repeated in units of frames in a first period 611 and a white signal and a black signal (image signal or data voltage corresponding to a black color) is alternately repeated in units of frames in a second period 612.

Referring to FIG. 6, when the white signal and the black signal cross in short units (e.g., frame units), since the potential difference of the white signal is greater than that of the black signal, a common voltage shift in which the common voltage 601 is biased toward the white signal may occur.

Specifically, in the data voltage 602 in the first period 611, the white signal is repeated in units of frames, and the common voltage 601 has an intermediate value between the crest and the trough of the data voltage 602. Accordingly, in the first period 611, the potential difference between the white signal of the crest and the common voltage 601 and the potential difference between the white signal of the trough and the common voltage 601 are the same.

However, in the data voltage 602 in the second period 612, a white signal and a black signal are repeated in units of frames, and the intermediate value between the crest and trough of the data voltage 602 increases. Accordingly, a common voltage shift in which the common voltage 601 is biased (increased) in the direction (positive direction) of the white signal may occur.

Figure 7:
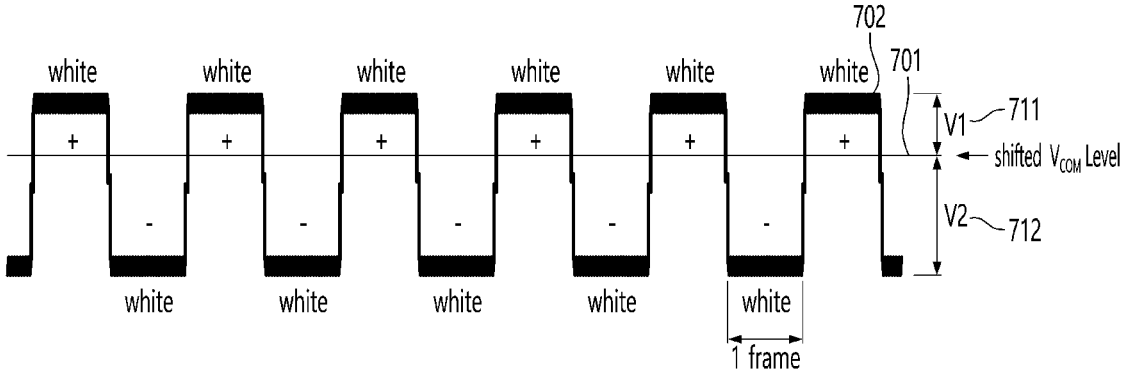
FIG. 7 is a view illustrating a common voltage and a data voltage in a situation in which a common voltage shift occurs.

FIG. 7 is a view illustrating a common voltage and a data voltage in a situation in which a common voltage shift occurs.

In the data voltage 702 shown in FIG. 7, a white signal is repeated in units of frames in a situation in which a positive common voltage shift ($V_{COM}$ shift) occurs.

Referring to FIG. 7, as the common voltage $V_{COM}$ 701 is shifted to a positive side, the level of the shifted common voltage 701 is greater than the intermediate value between the crest and trough of the data voltage 702. In the data voltage 702, the white signal is repeated in units of frames, but, since a positive common voltage shift has occurred, the potential difference V1 711 between the crest of the data voltage 702 and the common voltage 701 is less than the potential difference V2 712 between the trough of the data voltage 702 and the common voltage 701. In the data voltage 702, positive and negative white signals having the same intensity are repeated in units of frames, but, as the common voltage 701 is shifted, the positive white signal corresponds to brightness darker than intended brightness as the potential difference V1 711 decreases, and the negative white signal corresponds to brightness brighter than intended brightness as the potential difference V2 712 increases.

When the common voltage 701 is shifted, even when a normal data voltage 702 is applied, distortion occurs in the potential difference, so that the brightness output from the pixel is changed, and, accordingly, an afterimage or flicker may occur in the display. Accordingly, by controlling the common voltage 701 not to be shifted, it is possible to prevent an afterimage or flicker of the display.

Figure 8:
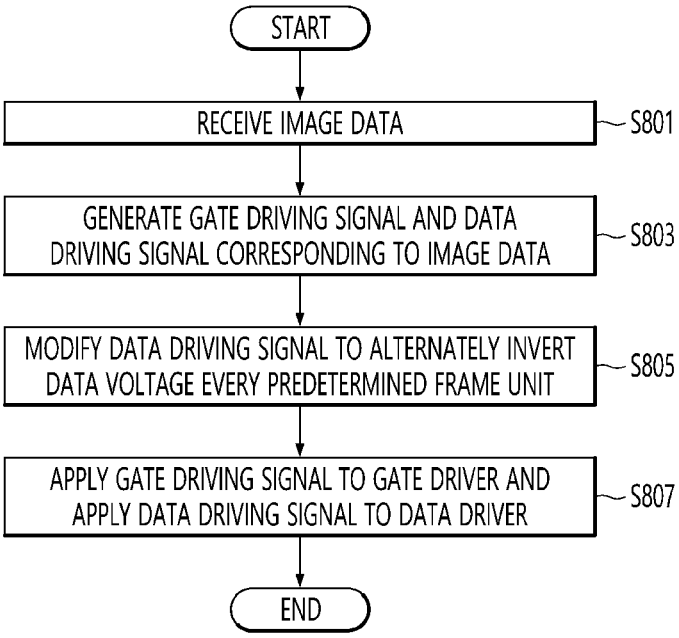
FIG. 8 is a flowchart illustrating a method of operating a liquid crystal display device according to an embodiment of the present disclosure.

FIG. 8 is a flowchart illustrating a method of operating a liquid crystal display device according to an embodiment of the present disclosure.

Referring to FIG. 8, the external input interface 110 of the liquid crystal display device 100 receives image data (S801).

The image data may include one or more of RGB data, a clock signal, a horizontal synchronization signal, a vertical synchronization signal and a data enable signal.

In addition, the timing controller 120 of the liquid crystal display device 100 generates a gate driving signal and a data driving signal corresponding to the image data (S803).

The gate driving signal is a signal for driving the gate driver 140, and the data driving signal is a signal for driving the data driver 150. The data driving signal may be used to generate a data voltage in the data driver 150.

In addition, the timing controller 120 of the liquid crystal display device 100 modifies the data driving signal so as to alternately invert the polarity of the data voltage every predetermined frame unit with respect to the generated data driving signal (S805).

A data voltage (or an image signal or a data signal) applied to each pixel may be generated based on the data driving signal in the data driver 150. The timing controller 120 may modify the polarity of the data voltage applied to each pixel in the data driver 150 by modifying the generated data driving signal.

The timing controller 120 may modify the generated data driving signal such that the polarity is inverted at a predetermined period or every a predetermined frame unit by comparing the data voltage to be applied to each pixel with an original data voltage generated in response to the image data.

The predetermined period or the predetermined frame unit may be determined by user setting, or may be a value preset by an administrator. The predetermined period may have a value of 24 frames, 30 frames, 144 frames, and the like.

In addition, the predetermined period may be set in units of time. For example, the predetermined period may have a value of 1 second or 0.5 second.

In an embodiment, the predetermined period may be determined in consideration of the scan rate of the display panel. If the scan rate of the display device is 144 hz and the predetermined period is set to 0.5 second in units of time, the predetermined period may be 72 frames in units of frames. That is, the predetermined period may be a product of the scan rate and the predetermined period in units of time.

In addition, the timing controller 120 of the liquid crystal display device 100 applies the generated gate driving signal to the gate driver 140 and applies the modified data driving signal to the data driver 150 (S807).

The gate driver 140 may apply a gate signal corresponding to the gate driving signal to each of the gate lines GL1 to GLn, and the data driver 150 may apply a data voltage corresponding to the data driving signal to each of the data lines DL1 to DLm.

Figure 9:
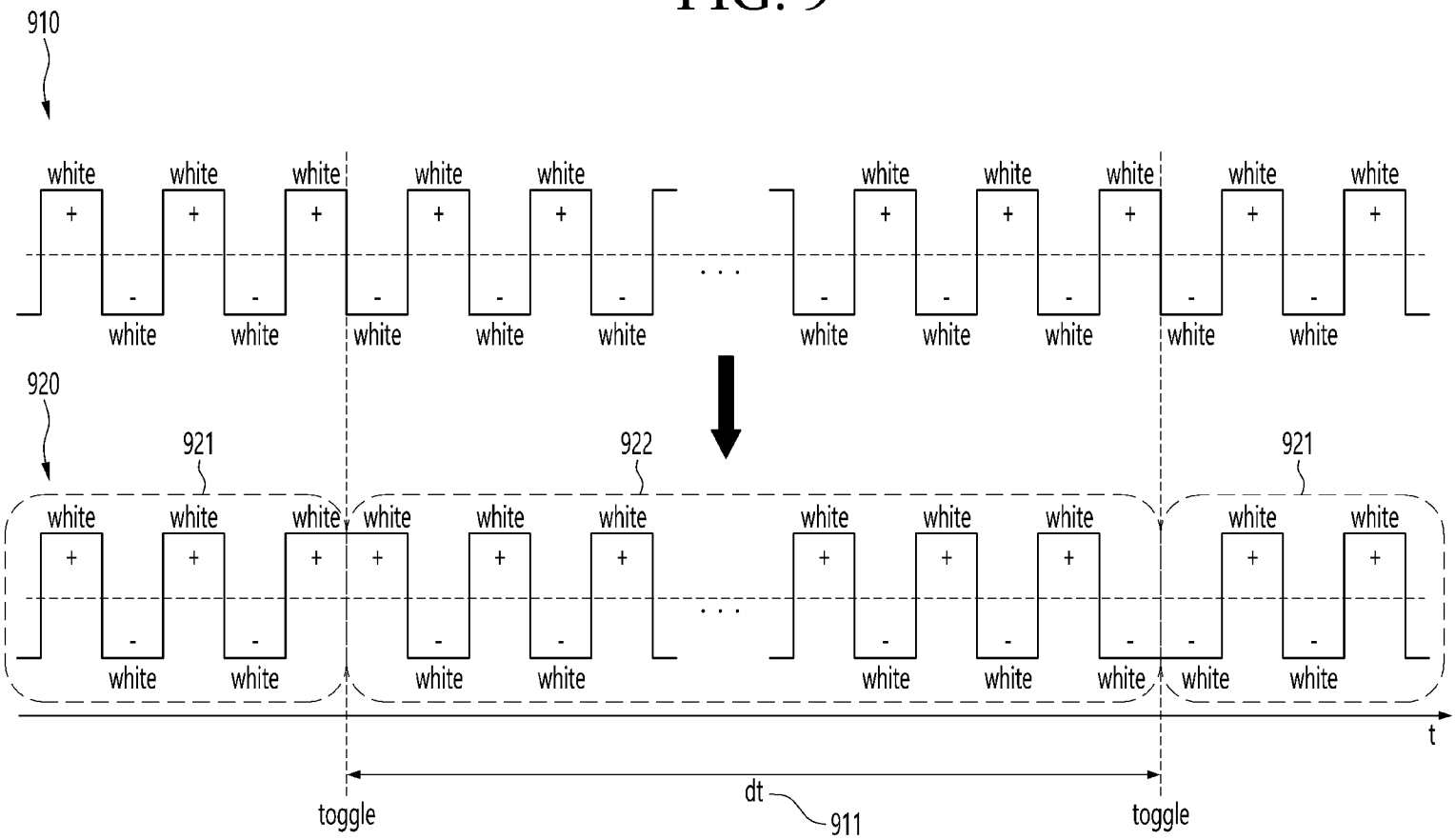
FIG. 9 is a view showing an example of the modified data voltage according to an embodiment of the present disclosure.

FIG. 9 is a view showing an example of the modified data voltage according to an embodiment of the present disclosure.

Specifically, FIG. 9 shows an original data voltage 910 generated in response to image data and a data voltage 920 modified from the original data voltage 910 to improve an afterimage or flicker.

Referring to FIG. 9, the original data voltage 910 may be a data voltage in which a positive white signal and a negative white signal are alternately repeated at an interval of one frame.

The liquid crystal display device 100 may generate the modified data voltage 920 by toggling or inverting the polarity of the original data voltage 910 at a predetermined period or every predetermined frame unit 911. That is, the modified data voltage 920 may include first periods 921 and 923 having the same polarity as the original data voltage 910 and a second period 922 having the opposite polarity to the original data voltage 910. In addition, the modified data voltage 920 may alternately include the first periods 921 and 923 and the second period 922.

If the predetermined frame unit 911 is 30 frames, the liquid crystal display device 100 may generate the modified data voltage 920 by inverting the polarity of the original data voltage 910 every 30 frames. In this case, the modified data voltage 920 may alternately include 30 frames having the same polarity as the original data voltage 910 and 30 frames having the opposite polarity to the original data voltage 910.

Figure 10:
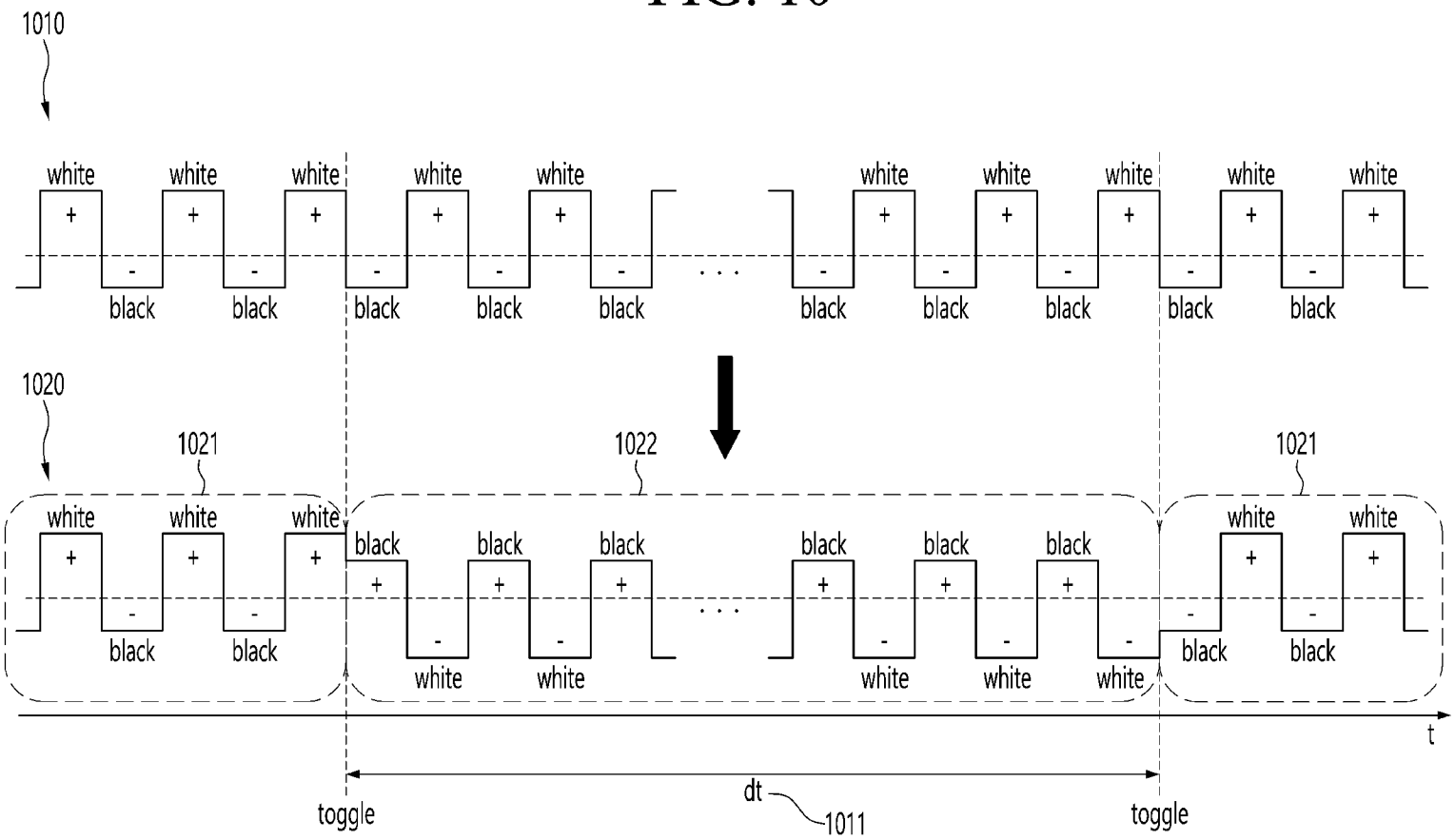
FIG. 10 is a view showing an example of a modified data volage according to an embodiment of the present disclosure.

FIG. 10 is a view showing an example of a modified data volage according to an embodiment of the present disclosure.

Specifically, FIG. 10 shows an original data voltage 1010 generated in response to image data and a data voltage 1020 modified from the original data voltage 1010 to improve an afterimage or flicker.

Referring to FIG. 10, the original data voltage 1010 may be a data voltage in which a positive white signal and a negative black signal are alternately repeated at an interval of one frame.

The liquid crystal display device 100 may generate the modified data voltage 1020 by toggling or inverting the polarity of the original data voltage 1010 at a predetermined period or every predetermined frame unit 1011. That is, the modified data voltage 1020 may include a first period 1021 having the same polarity as the original data voltage 1010 and a second period 1022 having a polarity opposite to the original data voltage 1010. In addition, the modified data voltage 1020 may alternately include the first period 1021 and the second period 1022.

Since a positive white signal and a negative black signal are alternately repeated in the original data voltage 1010, a positive white signal and a negative black signal are alternately repeated in the first period 1021 of the modified data voltage 1020. In addition, in the second period 1022 of the modified data voltage 1020, a negative white signal and a positive black signal are alternately repeated.

FIG. 9 shows an example of a data signal in which a white signal is repeated, and FIG. 10 shows an example of a data signal in which a white signal and a black signal are alternately repeated, but the present disclosure is not limited thereto. That is, in various embodiments of the present disclosure, the liquid crystal display device 100 may toggle or invert the polarity of various original data voltages generated from the image data every predetermined frame unit.

According to an embodiment of the present disclosure, the above-described method can be implemented as computer-readable code in a medium in which a program is recorded. The computer-readable medium includes all types of recording devices in which data readable by a computer system is stored. Examples of computer-readable media include Hard Disk Drive (HDD), Solid State Disk (SSD), Silicon Disk Drive (SDD), ROM, RAM, CD-ROM, magnetic tape, floppy disk, optical data storage device, etc.

The invention claimed is:

1. A liquid crystal display device comprising:

a display panel having a plurality of gate lines and a plurality of data lines formed thereon and including a plurality of pixels;

a gate driver configured to apply a gate signal to the plurality of gate lines;

a data driver configured to apply a data voltage to the plurality of data lines; and a timing controller configured to generate a gate driving signal and a data driving signal corresponding to image data, to modify the generated data driving signal to alternately invert a polarity of the data voltage at a predetermined period with respect to the generated data driving signal, to apply the generated gate driving signal to the gate driver, and to apply the modified data driving signal to the data driver, wherein the gate driver generates a gate signal corresponding to the generated gate driving signal and applies the generated gate signal to the plurality of gate lines, wherein the data driver generates a data voltage corresponding to the modified data driving signal and applies the generated data voltage to the plurality of data lines, wherein the generated data voltage comprises a first period in which a polarity is not inverted and a second period in which a polarity is not inverted, the first period and the second period being alternately arranged, and wherein the predetermined period is a value set by user input.

2. The liquid crystal display device of claim 1, wherein the predetermined period is a unit of time or a unit of frame.

3. The liquid crystal display device of claim 2, wherein the predetermined period is determined in consideration of a scan rate of the display panel.

4. The liquid crystal display device of claim 3, wherein the predetermined period is a product of the scan rate and a predetermined period in units of time.

5. A method of operating a liquid crystal display device comprising a display panel having a plurality of gate lines and a plurality of data lines formed thereon and including a plurality of pixels; a gate driver configured to apply a gate signal to the plurality of gate lines; and a data driver configured to apply a data voltage to the plurality of data lines, the method comprising:

generating a gate driving signal and a data driving signal corresponding to image data;

modifying the generated data driving signal to alternately invert a polarity of the data voltage at a predetermined period with respect to the generated data driving signal;

applying the generated gate driving signal to the gate driver; and applying the modified data driving signal to the data driver wherein the method further comprises:

generating a gate signal corresponding to the generated gate driving signal;

applying the generated gate signal to the plurality of gate lines;

generating a data voltage corresponding to the modified data driving signal; and applying the generated data voltage to the plurality of data lines, wherein the generated data voltage comprises a first period in which a polarity is not inverted and a second period in which a polarity is not inverted, the first period and the second period being alternately arranged, and wherein the predetermined period is a value set by user input.

6. The method of claim 5, wherein the predetermined period is a unit of time or a unit of frame.

7. The method of claim 6, wherein the predetermined period is determined in consideration of a scan rate of the display panel.

8. The method of claim 7, wherein the predetermined period is a product of the scan rate and a predetermined period in units of time.

* * * * *